US008864292B2

(12) United States Patent
Kanbe et al.

(10) Patent No.: US 8,864,292 B2
(45) Date of Patent: Oct. 21, 2014

(54) PRINT FLUID CARTRIDGE HAVING ELECTRIC INTERFACE

(71) Applicants: Tomohiro Kanbe, Nagoya (JP); Yuki Takagi, Nagoya (JP); Hirotake Nakamura, Nagoya (JP)

(72) Inventors: Tomohiro Kanbe, Nagoya (JP); Yuki Takagi, Nagoya (JP); Hirotake Nakamura, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/837,437

(22) Filed: Mar. 15, 2013

(65) Prior Publication Data

US 2013/0278683 A1 Oct. 24, 2013

(30) Foreign Application Priority Data

Apr. 19, 2012 (JP) ..... 2012-095695

(51) Int. Cl.
*B41J 2/175* (2006.01)
*B41J 2/17* (2006.01)

(52) U.S. Cl.
CPC ..... *B41J 2/17526* (2013.01); *B41J 2/17553* (2013.01); *B41J 2/17513* (2013.01)
USPC ..... 347/86; 347/84; 347/85

(58) Field of Classification Search
CPC .. B41J 2/1752; B41J 2/17553; B41J 2/17526; B41J 2/17513
USPC ..... 347/84, 85, 86
See application file for complete search history.

(56) References Cited

U.S. PATENT DOCUMENTS

| | | | | |
|---|---|---|---|---|
| 6,416,152 | B1 | 7/2002 | Matsuzaki et al. | |
| 2003/0071874 | A1 * | 4/2003 | Ishizawa et al. | 347/50 |
| 2009/0027464 | A1 * | 1/2009 | Berg | 347/86 |
| 2013/0141499 | A1 * | 6/2013 | Tomoguchi et al. | 347/86 |

FOREIGN PATENT DOCUMENTS

| | | | |
|---|---|---|---|
| JP | 2000-037880 | A | 2/2000 |
| JP | 2009-132098 | A | 6/2009 |

* cited by examiner

*Primary Examiner* — Jannelle M Lebron
(74) *Attorney, Agent, or Firm* — Baker Botts L.L.P.

(57) ABSTRACT

In a print fluid cartridge, a main body has a first surface facing in a first direction. A print fluid outlet part is provided on the main body, and has an opening at the first surface. An electric interface is provided at an external surface of the main body and faces in a second direction orthogonal to the first direction. The electric interface moves relative to the main body in the first direction and in a direction opposite to the first direction between a first position and a second position that are apart from each other in the first direction and the direction opposite to the first direction. The main body supports the electric interface at the second position against pressure that is applied to the electric interface in a direction opposite to the second direction.

12 Claims, 11 Drawing Sheets

PRINT FLUID CARTRIDGE HAVING ELECTRIC INTERFACE

CROSS REFERENCE TO RELATED APPLICATION

This application claims priority from Japanese Patent Application No. 2012-095695 filed Apr. 19, 2012. The entire content of the priority application is incorporated herein by reference.

TECHNICAL FIELD

The present invention relates to a print fluid cartridge having a print fluid outlet part and an electric interface.

BACKGROUND

There is known an image forming device that forms an image on a recording sheet by using ink. Such image forming device includes an ink-jet type recording head having nozzles through which ink droplets are selectively ejected onto the sheet. The ink droplets are deposited on the recording sheet to form a desired image. The image forming device has a cartridge accommodating section, and uses an ink cartridge storing therein ink to be supplied into the recording head. The ink cartridge is loadable on and removable from the cartridge accommodating section. This image forming device is disclosed in Japanese Patent Application Publication No. 2009-132098, for example.

Some ink cartridge is provided with an electronic component, such as a memory module, for providing information on the ink cartridge, such as color of ink, material of the ink, residual amount of ink, and a maintenance state. When the ink cartridge is mounted in the cartridge accommodating section, the memory module is electrically connected to a contact portion or contact point provided on the cartridge accommodating section to render the stored information accessible.

SUMMARY

The ink cartridge mounted in the cartridge accommodating section has at least its ink outlet part positioned relative to the cartridge accommodating section. The electronic component such as the memory module is preferably avoided from contacting ink. However, when an ink needle is inserted into or is removed from the ink outlet part of the ink cartridge, ink may still possibly scatter from the ink outlet part and become adhered on the electronic component and the contact portion, that are disposed away from the ink outlet part.

One conceivable ink cartridge has the electric component (memory module) disposed at a position remote from the ink outlet part to avoid contact with ink. However, arranging the electronic component as far away from the ink outlet part as possible would lead to unstable positioning of the electronic component relative to the ink outlet part, resulting in unstable electric connection between the electronic component and the contact point.

In view of the foregoing, it is an object of the present invention to provide a print fluid cartridge that can prevent print fluid from being attached onto the electric interface provided on the print fluid cartridge and the contact portion in the cartridge accommodating section.

In order to attain the above and other objects, the present invention provides a print fluid cartridge including: a main body; a print fluid outlet part; and an electric interface. The main body has a first surface and a second surface, the first surface facing in a first direction, the second surface being located upstream of the first surface in the first direction. The main body further has a chamber configured to store print fluid at a position between the first surface and the second surface. The print fluid outlet part is provided on the main body, has an opening at the first surface, and is configured to direct the print fluid from the chamber to an exterior of the main body. The electric interface is provided at an external surface of the main body and faces in a second direction that is orthogonal to the first direction. The electric interface is configured to move relative to the main body in the first direction and in a direction opposite to the first direction between a first position and a second position that are apart from each other in the first direction and the direction opposite to the first direction. The main body is configured to support the electric interface at the second position against pressure that is applied to the electric interface from outside the print fluid cartridge in a direction opposite to the second direction.

BRIEF DESCRIPTION OF THE DRAWINGS

In the drawings:

FIGS. 5 and 6 are vertical cross-sectional views of the ink cartridge and the cartridge accommodating section, showing how the ink cartridge is mounted in the cartridge accommodating section, wherein FIG. 5 shows the states of the ink cartridge and the cartridge accommodating section when the ink cartridge is on its way to be mounted in the cartridge accommodating section, and FIG. 6 shows the states of the ink cartridge and the cartridge accommodating section when the ink cartridge is fully mounted in the cartridge accommodating section;

FIGS. 8 and 9 are vertical cross-sectional views of the ink cartridge and a cartridge accommodating section according to the second embodiment of the present invention, showing how the ink cartridge is mounted in the cartridge accommodating section, wherein FIG. 8 shows the states of the ink cartridge and the cartridge accommodating section when the ink cartridge is on its way to be mounted in the cartridge accommodating section, and FIG. 9 shows the states of the ink cartridge and the cartridge accommodating section when the ink cartridge is fully mounted in the cartridge accommodating section; and FIGS. 10 and 11 are perspective views showing an external configuration of an ink cartridge according to a modification of the second embodiment, in which FIG. 10 is for a case where a supporting member is at a first position, and FIG. 11 is for a case where the supporting member is at a second position.

DETAILED DESCRIPTION

An ink cartridge 30 according to a first embodiment of the present invention will be described with reference to FIGS. 1 through 6.

Overall Structure of Printer

Figure 1:
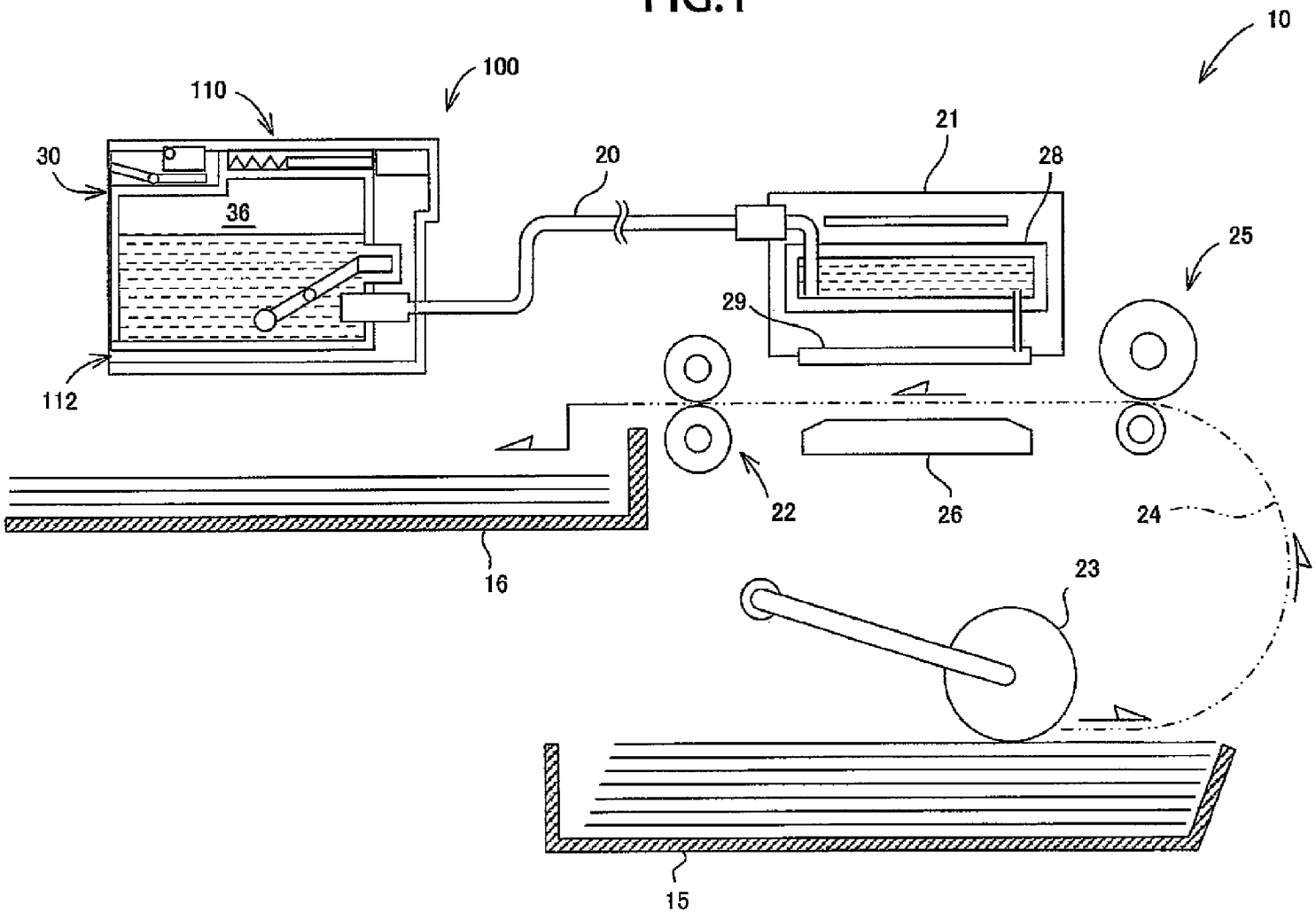
FIG. 1 is a schematic view showing an internal construction of a printer having a cartridge accommodating section, in which an ink cartridge according to a first embodiment of the present invention is mounted.

First, a printer 10 according to the first embodiment of the present invention will be described with reference to FIG. 1. Hereinafter, the terms "upward", "downward", "upper", "lower", "above", "below", "beneath", "right", "left", "front", "rear" and the like will be used throughout the description assuming that the printer 10 and the ink cartridge 30 are disposed in an orientation in which they are intended to be used.

The printer 10 is configured to form an image by selectively ejecting ink droplets onto a sheet in accordance with an ink jet recording system. As shown in FIG. 1, the printer 10 includes an ink supply device 100 provided with a cartridge accommodating section 110 configured to detachably accommodate the ink cartridge 30 therein. The cartridge accommodating section 110 has one side formed with an opening 112 exposed to an atmosphere. The ink cartridge 30 can be inserted into and removed from the cartridge accommodating section 110 through the opening 112.

The ink cartridge 30 accommodates therein ink to be used in the printer 10. The printer 10 includes a recording head 21 connected to the ink cartridge 30 through an ink tube 20 when the ink cartridge 30 is installed in the cartridge accommodating section 110. The recording head 21 has a sub tank 28 in which ink supplied through the ink tube 20 is temporarily stored. The recording head 21 also includes nozzles 29 through which ink supplied from the sub tank 28 is selectively ejected in accordance with the ink jet recording system.

The printer 10 also includes a sheet supply tray 15, a sheet supply roller 23, a sheet passage 24, a pair of transfer rollers 25, a platen 26, a pair of discharge rollers 22, and a discharge tray 16 arranged in this order in a sheet feeding direction. The sheet supplied from the sheet supply tray 15 to the sheet passage 24 by the sheet supply roller 23 is conveyed to the platen 26 by the pair of transfer rollers 25. Then, ink is selectively ejected from the recording head 21 onto the sheet passing on the platen 26 to form an ink image on the sheet. The sheet is then discharged onto the discharge tray 16 by the pair of discharge rollers 22.

Detailed Structure of Ink Cartridge

Next, the ink cartridge 30 will be described with reference to FIGS. 2 *and* 3.

Figure 2:
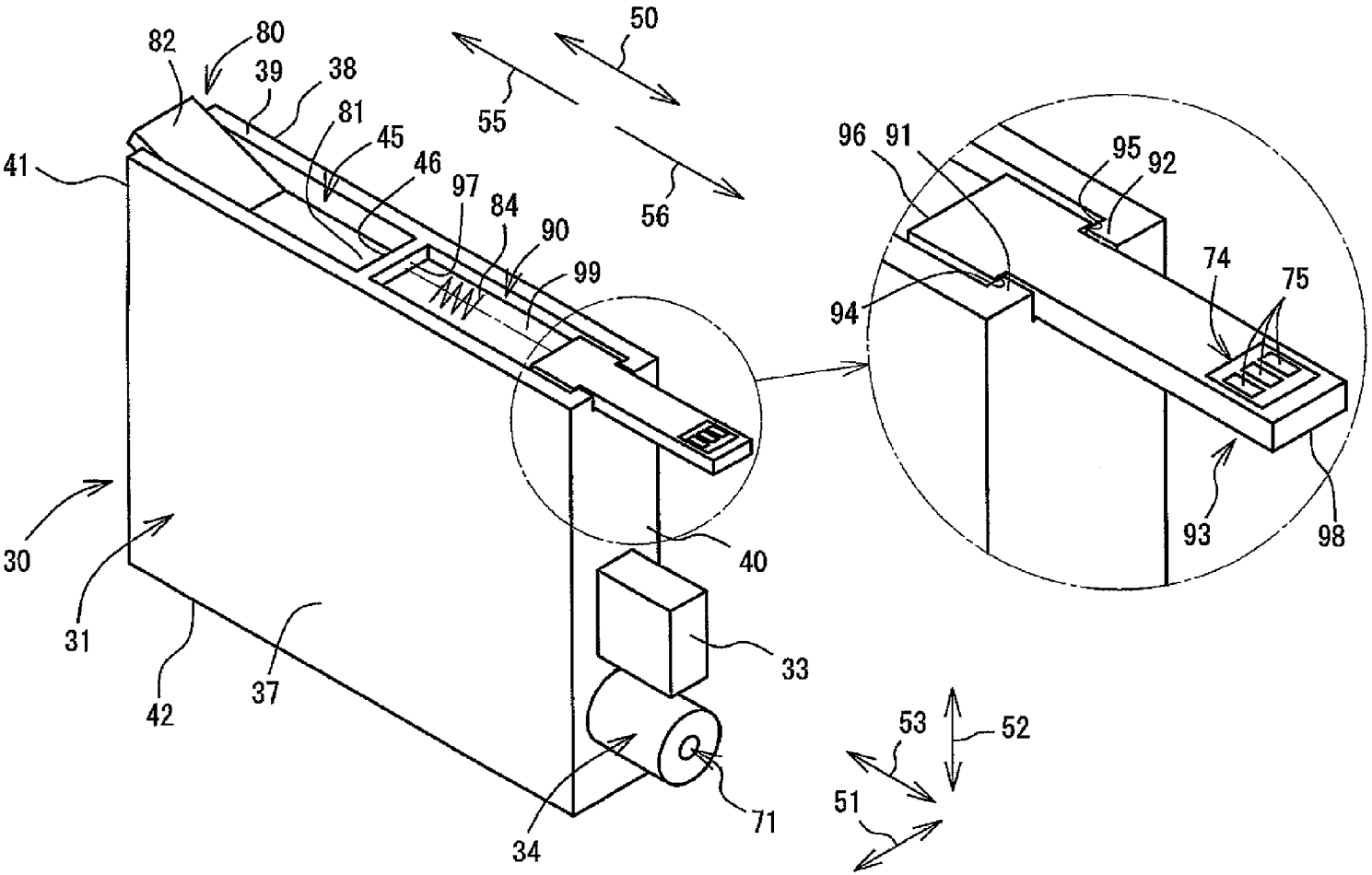
FIG. 2 is a perspective view showing an external configuration of the ink cartridge shown in FIG. 1.
Figure 3:
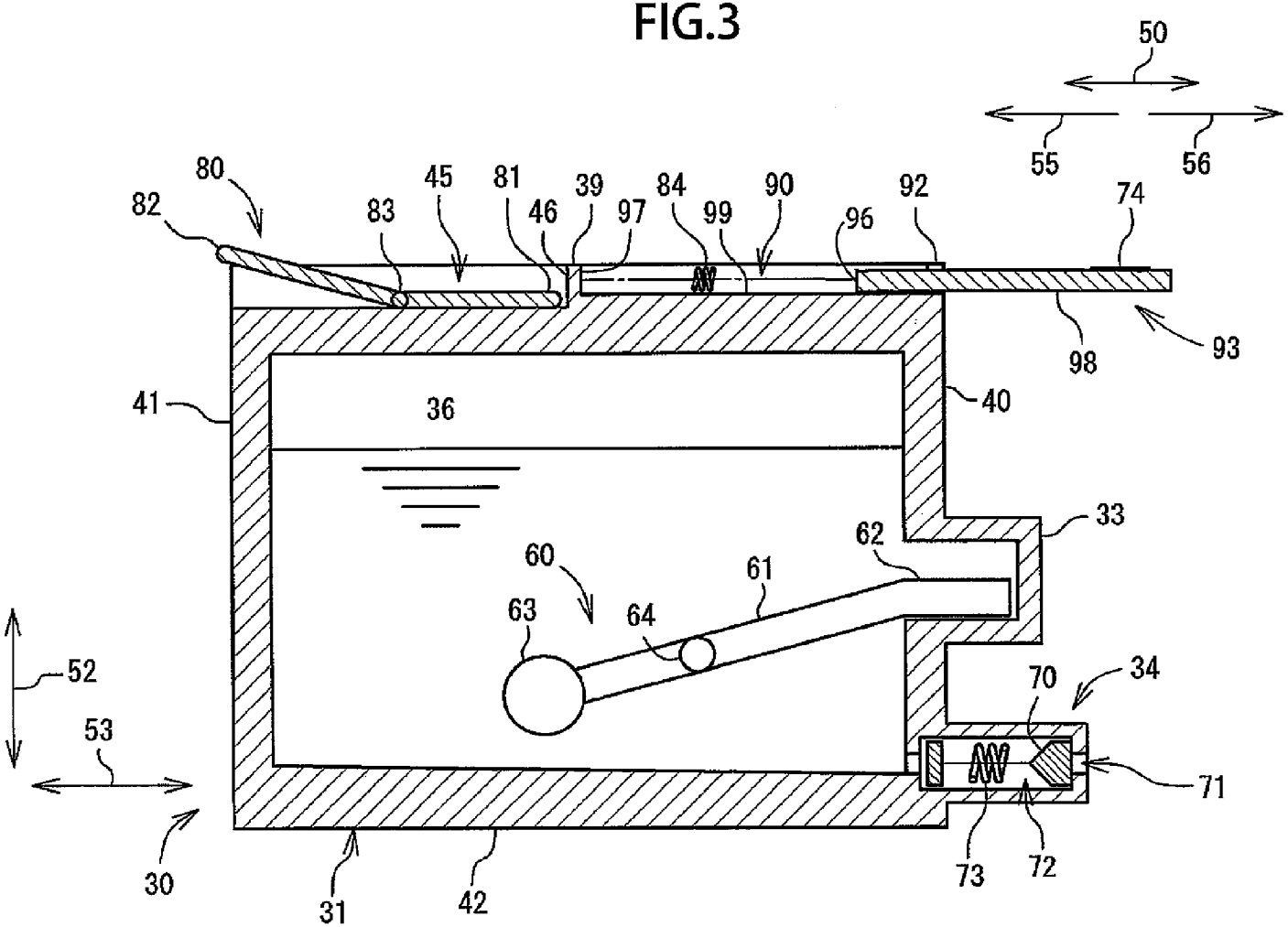
FIG. 3 is a vertical cross-sectional view showing the internal configuration of the ink cartridge.

The ink cartridge 30 is mounted in and removed from the cartridge accommodating section 110 in an upstanding posture shown in FIGS. 2 and 3. Specifically, the ink cartridge 30 is loaded into the cartridge accommodating section 110 in a loading direction 56, and is unloaded from the cartridge accommodating section 110 in an unloading direction 55 while maintaining the upstanding posture. Hereinafter, the loading direction 56 and the unloading direction 55 may be collectively referred to as a loading/unloading direction 50.

The loading/unloading direction 50 (both of the loading direction 56 and unloading direction 55) is coincident with a horizontal direction in the embodiment. However, the loading and unloading of the ink cartridge 30 relative to the cartridge accommodating section 110 may be performed in a direction parallel to a vertical direction, or a direction intersecting with both of the vertical and horizontal directions. For example, if the ink cartridge 30 is mounted in or removed from in the vertical direction (direction of a gravitational force), the ink cartridge has its front surface directed downward.

As shown in FIGS. 2 and 3, the ink cartridge 30 defines therein a hollow space serving as an ink chamber 36 in which ink is stored. The ink cartridge 30 has a cartridge body 31 defining an outer contour of the ink cartridge 30. The ink chamber 36 of the embodiment is defined by the cartridge body 31, but may be defined by an internal frame separate from the cartridge body 31 but inside the cartridge body 31.

The cartridge body 31 is configured of flat and/or curved surfaces, and has a generally flat rectangular parallelepiped shape, in this example. The cartridge body 31 has a width (in a direction indicated by an arrow 51 which will be referred to as widthwise direction or left/right direction), height (in a direction indicated by an arrow 52 which will be referred to as height direction or vertical direction) and depth (in a direction indicated by an arrow 53 which will be referred to as depthwise direction or front/rear direction), the height and depth being greater than the width. That is, in the embodiment, the height of the ink cartridge 30 in the upstanding posture is coincident with the vertical direction.

The cartridge body 31 has a front wall 40, a rear wall 41, a pair of side walls 37, 38, a top wall 39, and a bottom wall 42. The front wall 40 and the rear wall 41 are a leading end wall and a trailing end wall, respectively, when loading the ink cartridge 30 into a cartridge accommodating section 110 in the loading direction 56. The front wall 40 and the rear wall 41 are spaced away from each other in the depthwise direction 53. The loading/unloading direction 50 (loading and unloading directions 56, 55) of the ink cartridge 30 relative to the cartridge accommodating section 110 is coincident with the depthwise direction 53. The pair of side walls 37, 38 extends in the depthwise direction 53 and is connected to the front wall 40 and the rear wall 41. The top wall 39 extends in the depthwise direction 53 for connecting upper ends of the front wall 40, rear wall 41, and the pair of side walls 37, 38. The bottom wall 42 extends in the depthwise direction 53 for connecting lower ends of the front wall 40, rear wall 41, and the pair of side walls 37, 38. The ink chamber 36 is positioned between the front wall 40 and the rear wall 41, between the side walls 37 and 38, and between the bottom wall 42 and the top wall 39. An external surface of the front wall 40 serves as a front surface of the cartridge body 31, an external surface of the rear wall 41 serves as a rear surface of the cartridge body 31, an external surface of the upper wall 39 serves as an upper surface of the cartridge body 31, and an external surface of the bottom wall 42 serves as a lower surface of the cartridge body 31.

A residual amount detection portion 33 protrudes frontward (in the depthwise direction 53) from the front wall 40 at a generally intermediate position in the vertical direction 52. The residual amount detection portion 33 has a box shape whose one end is open so as to be in fluid communication with the inside of the ink chamber 36. Specifically, the residual amount detection portion 33 has a pair of confronting side walls, a front wall, an upper wall and a lower wall all made from a light transmissive resin. In the embodiment, the walls constituting the residual amount detection portion 33 allow light emitted from an optical sensor 114 (FIG. 4) to pass therethrough in a direction perpendicular to the loading/unloading direction 50 (i.e., the widthwise direction 51 in the embodiment). Alternatively, the residual amount detection portion 33 may be configured to reflect light that is incident thereon at an angle exceeding a predetermined critical angle. The light may be infrared light or visible light.

As shown in FIG. 3, the residual amount detection portion 33 provides therein a hollow space capable of storing ink therein. A sensor arm 60 is movably provided in the ink chamber 36. The sensor arm 60 includes an arm body 61 and a pivot shaft 64. The arm body 61 is plate shaped, and is pivotally movably supported to the pivot shaft 64. The pivot shaft 64 extends in the widthwise direction 51 and is supported to the pair of side walls 37, 38. The arm body 61 has one free end provided with an indicator 62 movably positioned in the hollow space of the residual amount detection portion 33, and another free end provided with a float 63 dipped in the ink. With this structure, the sensor arm 60 is adapted to change its pivoting posture in accordance with an amount of the ink in the ink chamber 36 between a lower position in which the indicator 62 approaches the lower wall of the residual amount detection portion 33 and an upper position in which the indicator 62 approaches the upper wall of the residual amount detection portion 33. In FIG. 3, the indicator 62 is at its lower position, as more than a prescribed amount of the ink is left in the ink chamber 36.

When the ink cartridge 30 is mounted in the cartridge accommodating section 110, the residual amount detection portion 33 is changeable between a transmissive state and a non-transmissive state. In the transmissive state, not less than a predetermined amount of infrared light from the optical sensor 114 can be transmitted through the residual amount detection portion 33, and in the non-transmisive state, less than the predetermined amount of infrared light is transmitted therethrough (the light is shut off or attenuated). More specifically, the transmissive state and non-transmissive state are provided when the indicator 62 is at its upper position and lower position, respectively. In accordance with whether the residual amount detection portion 33 is at the transmissive state or not, it can be detected whether or not the amount of ink in the ink chamber 36 is less than the prescribed amount.

As an alternative configuration, the above-described sensor arm 60 can be dispensed with. In this case, less than a predetermined amount of infrared light from the optical sensor 114 is transmitted through the residual amount detection portion 33 (the light is shut off or attenuated), when there is ink in the residual amount detection portion 33. On the other hand, when there is no ink left in the residual amount detection portion 33, not less than the predetermined amount of infrared light can be transmitted therethrough.

Alternatively, the residual amount detection portion 33 may be formed by a flexible film. A pivotally movable lever is provided to be in contact with the film. The film expands (is inflated) if the ink is in the residual amount detection portion 33, and the lever is maintained at a position at which the infrared light is shut off. On the other hand, when no ink remains in the residual amount detection portion 33, the film is deflated and the lever is pivotally moved either upward or downward to a position at which the infrared light is not shut off.

Still alternatively, the residual amount detection portion 33 may be configured such that, the infrared light emitted from a light emitting element can be reflected to avoid incidence into a light receiving element if ink is in the residual amount detection portion 33, and the infrared light emitted from the light emitting element can be reflected to be falling onto the light receiving element if no ink remains within the residual amount detection portion 33.

As shown in FIGS. 2 and 3, an ink outlet portion 34 is provided at the front wall 40 at a position below the residual amount detection portion 33. The ink outlet portion 34 has a hollow cylindrical shape protruding from the front wall 40 frontward in the loading direction 56. The ink outlet portion 34 has a tip end portion (front end portion) in which an ink outlet opening 71 is formed. An ink passage 72 is formed in an internal space of the ink outlet portion 34 to extend from the ink outlet opening 71 in the unloading direction 55 and communicate with the ink chamber 36. The ink outlet opening 71 can be opened and closed by an ink supply valve 70. The ink supply valve 70 is biased toward the ink outlet opening 71 by a coil spring 73 disposed within the internal space of the ink outlet portion 34.

Figure 4:
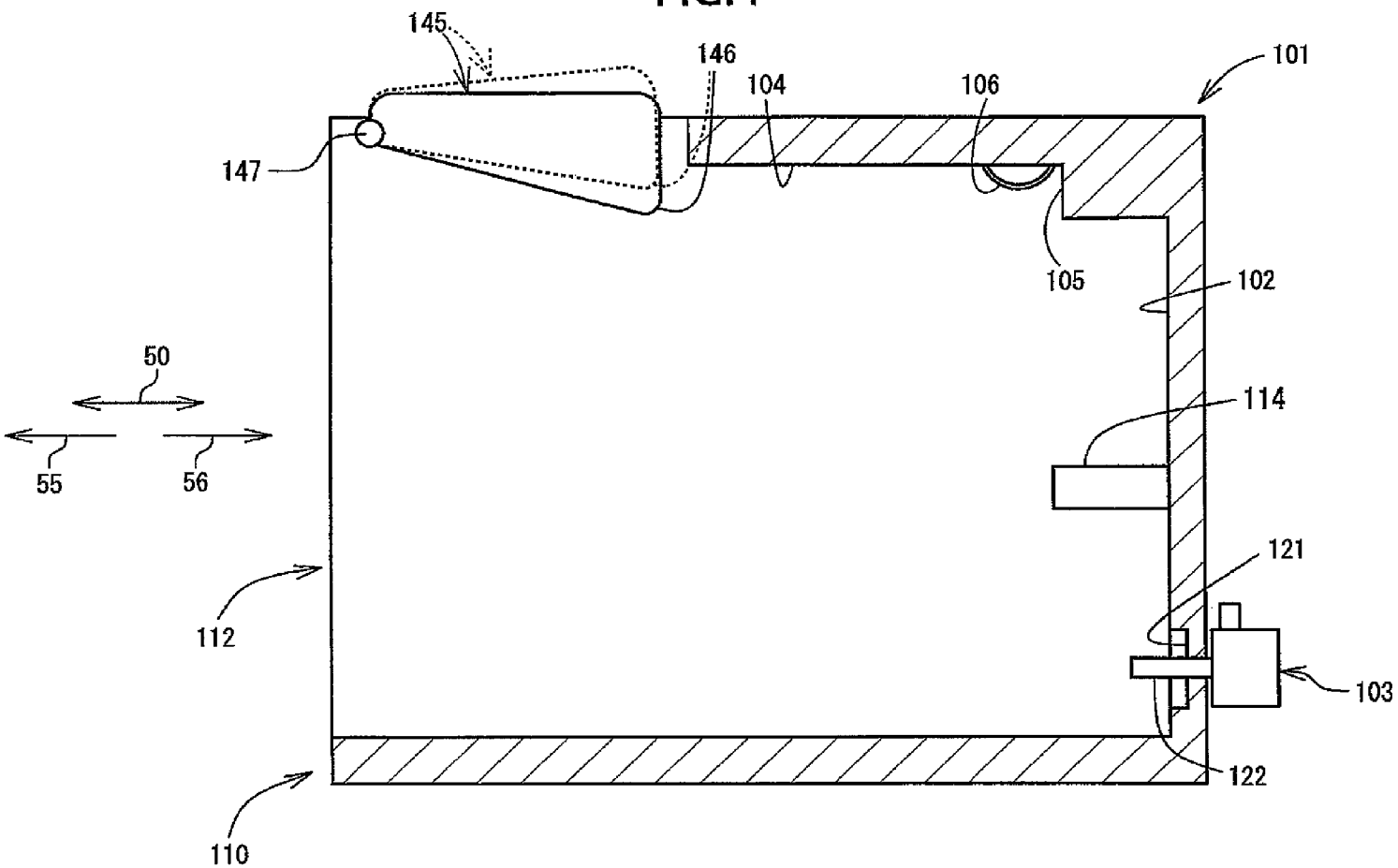
FIG. 4 is a vertical cross-sectional view showing the configuration of the cartridge accommodating section shown in FIG. 1.

The cartridge accommodating section 110 is provided with an ink needle 122 (FIG. 4). Upon loading the ink cartridge 30 into cartridge accommodating section 110, the ink needle 122 is inserted into the ink outlet opening 71 to move the ink supply valve 70 in the unloading direction 55 against a biasing force of the coil spring 73 to separate the ink supply valve 70 away from the ink outlet opening 71, whereupon ink flows out of the ink chamber 36 into the ink needle 122 through the ink passage 72.

Incidentally, instead of the ink supply valve 70, a film covering the ink outlet opening 71 is available. In the latter case, upon loading the ink cartridge 30 into cartridge accommodating section 110, the ink needle 122 breaks the film to open the ink outlet opening 71.

Although not shown in the embodiment, the cartridge body 31 may be provided with an air communication port to allow an internal pressure within the ink chamber 36, which has been maintained as negative, to be equal to the atmospheric pressure.

A locking part 45 is formed extending from a generally intermediate portion of the upper wall 39 in the depthwise direction 53 to the rear wall 41. The locking part 45 is concaved downward from the upper wall 39 and has a locking surface 46 that extends in the widthwise direction 51 and in the height direction 52 and that faces in the unloading direction 55. An engagement member 145 (see FIG. 4) to be described later is engaged with the locking surface 46 in a state where the ink cartridge 30 is mounted in the cartridge accommodating section 110. The locking part 45 is for receiving an external force that is applied from the engagement member 145 in the loading direction 56.

A pivotable member 80 is provided in the locking part 45. The pivotable member 80 is formed into a bent plate shape in this example, and is disposed such that a longitudinal direction thereof follows the depthwise direction 53. The pivotable member 80 has a shaft 83 at a bent portion thereof. This shaft 83 extends in the widthwise direction 51 at a position away from the locking surface 46 toward the rear wall 41 side and is pivotably supported by the cartridge body 31. The pivotable member 80 is pivotable about the shaft 83. A leading end portion 81 of the pivotable member 80 is a terminal end of a front part of the pivotable member 80 that extends from the shaft 83 toward the front wall 40 side. A rear end portion 82 of the pivotable member 80 is a terminal end of a rear part of the pivotable member 80 that extends from the shaft 83 toward the rear wall 41 side.

When the pivotable member 80 is pivoted to such a degree that the leading end portion 81 reaches an uppermost position, the leading end portion 81 reaches a vertical level higher than the upper edge of the upper wall 39. Pushing down the leading end portion 81 causes the pivotable member 80 to pivot in a clockwise direction in FIG. 5. In a state where the pivotable member 80 is pivoted to a furthest position in the clockwise direction, the leading end portion 81 is located confronting a lower end of the locking surface 46.

The pivotable member 80 may be formed integrally with the cartridge body 31. Further, the pivotable member 80 may be biased by a coil spring in the clockwise direction or may be configured such that one side thereof is pivoted by its own weight.

A guide groove 90 is formed in the upper wall 39 on the front wall 40 side relative to the locking part 45. The guide groove 90 is located at a vertical level higher than the residual amount detection portion 33 in the height direction 52. The guide groove 90 is concaved downward from the upper wall 39, extends along the depthwise direction 53 as being sandwiched between the upper edges of the side walls 37 and 38. The guide groove 90 has a bottom surface 99 extending in the depthwise direction 53 and in the widthwise direction 51 and facing upwardly. The guide groove 90 has a rear-side terminal end surface 97 at its rear end that faces frontwardly. Protruding pieces 91 and 92 protrude from the upper edges of the side walls 37 and 38, respectively, at their front ends. The protruding pieces 91 and 92 protrude inward in the widthwise direction 51, and are opposed to each other in the widthwise direction 51. A gap is formed between the opposing ends of the protruding pieces 91 and 92. In this way, the guide groove 90 is opened in the front wall 40 through the gap between the protruding pieces 91 and 92. The protruding pieces 91 and 92 serve as stoppers for preventing a support plate 93 from falling off the guide groove 90 by abutting against the support plate 93.

The support plate 93 is fitted into the guide groove 90. The support plate 93 is formed into a flat-plate shape as a whole. The support plate 93 has a T-shape in a plan view, and has its front part narrower than its rear part in the widthwise direction 51. The support plate 93 has a pair of abutment surface portions 94 and 95 at its portion where the width of the support plate 93 is changed, that is, at its portion where the front part is connected to the rear part. The abutment surface portions 94 and 95 extend in the widthwise direction 51 and in the height direction 52 and face forwardly.

An IC substrate 74 is provided on an upper surface of the support plate 93 at its front end portion.

Three electrodes 75 (specifically, a HOT electrode, a GND electrode, and a signal electrode) are mounted on an upper surface of the IC substrate 74. The IC substrate 74 also has an IC (not shown) mounted thereon. The IC is a semiconductor integrated circuit and stores various information relating to the ink cartridge 30, for example, lot number, manufactured date, color of ink and so on. These data is retrievable from the IC when electrically accessed thereto.

The electrodes 75 (HOT electrode, GND electrode and signal electrode) are electrically connected to the IC. The electrodes 75 are respectively elongated in the depthwise direction 53, and arrayed in the widthwise direction 51 to be spaced away from one another. The electrodes 75 are thus arranged on the upper surface of the IC substrate 74 as being exposed facing upwardly to allow electrical access thereto from above.

The electrodes 75 are for being brought into electrically contact with contact portions 106 (see FIG. 4) in the cartridge accommodating section 110 in a process where the ink cartridge 30 is loaded in the cartridge accommodating section 110, and the electrical contact between the electrodes 75 and the contact portions 106 is maintained while the ink cartridge 30 is being fully mounted in the cartridge accommodating section 110. The electrical connection is released in a process where the ink cartridge 30 is unloaded in the cartridge accommodating section 110.

The support plate 93 is mounted in the guide groove 90 so as to be slidably movable in the depthwise direction 53 with a lower surface 98 of the support plate 93 being brought into sliding contact with the bottom surface 99 of the guide groove 90.

A coil spring 84 is provided in the guide groove 90 to extend between the rear-side terminal end surface 97 of the guide groove 90 and a rear end surface 96 of the support plate 93. The coil spring 84 is resiliently contractable in the depthwise direction 53. The support plate 93 is urged by the coil spring 84 in the loading direction 56. In a state where no external force other than the biasing force of the coil spring 84 is applied to the support plate 93, the support plate 93 is located at a first position (see FIG. 2) where the front part of the support plate 93 protrudes frontward from the front wall 40 through the gap between the opposing ends of the protruding pieces 91 and 92, with the abutment surface portions 94 and 95 abutting against the protruding pieces 91 and 92, respectively. When external force is applied onto the support plate 93 in the unloading direction 55 against the urging force of the coil spring 84, the coil spring 84 is resiliently contracted to allow the support plate 93 to be slid in the unloading direction 55. The support plate 93 moves in a direction toward the rear-side terminal end surface 97 of the guide groove 90, and reaches a second position. When the support plate 93 reaches the second position, almost the entire length of the support plate 93 in the loading/unloading direction 50 becomes accommodated in the guide groove 90 (see FIGS. 1 and 6). Thus, the second position is positioned on the rear wall 41 side relative to the first position. As described above, the support plate 93 can reciprocate between the first and second positions in accordance with the expansion/contraction of the coil spring 84.

Figure 6:
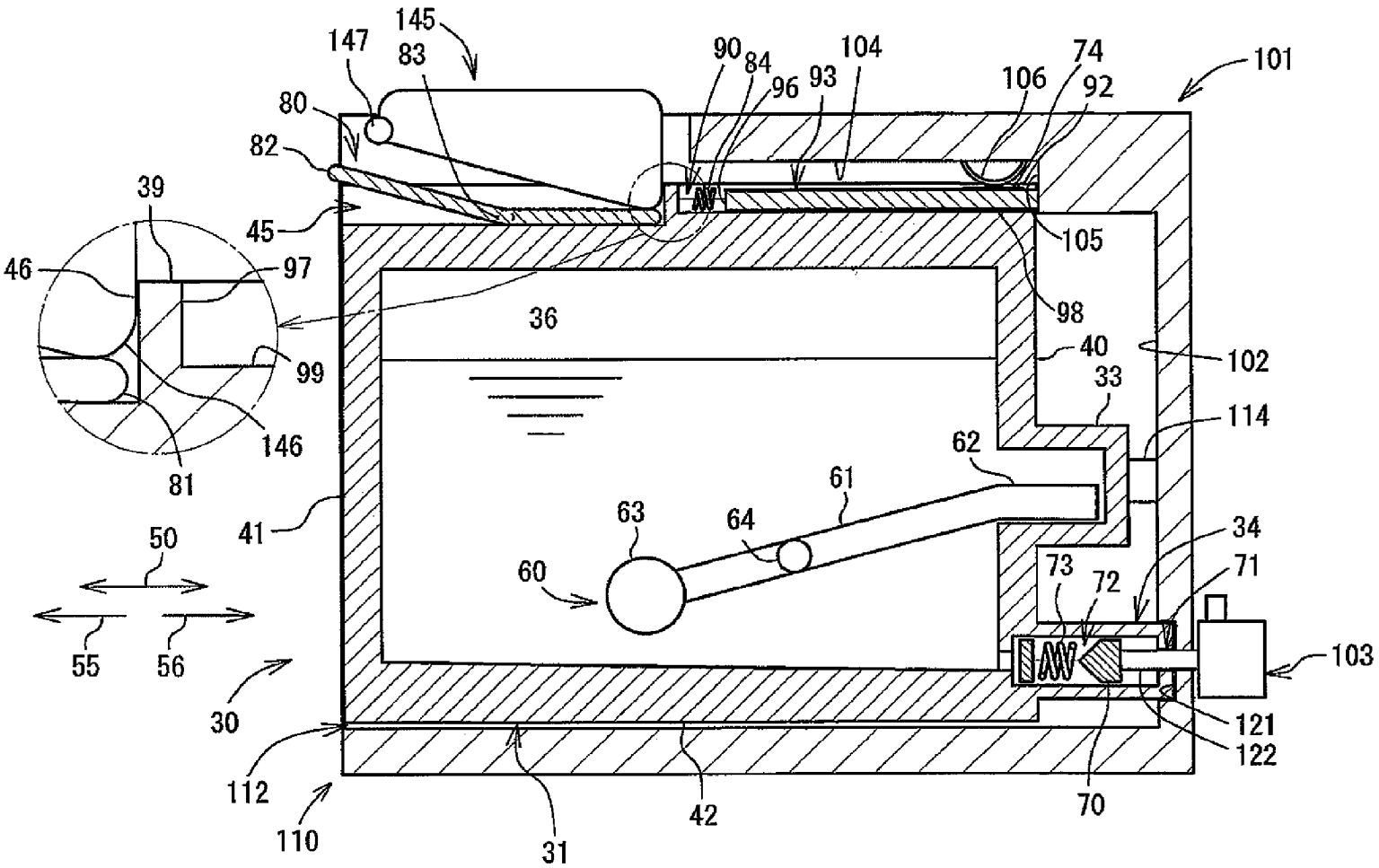

When the support plate 93 is located at the first position, the IC substrate 74 is located on the front side relative to the ink supply port 71, and therefore is located on the front side relative to the front wall 40 as shown in FIG. 3. When the support plate 93 is located at the second position as shown in FIG. 6, the IC substrate 74 is located on the rear wall 41 side relative to the front wall 40, and therefore is located on the rear wall 41 side relative to the ink supply port 71. When the support plate 93 is located at the second position, part of the lower surface 98 of the support plate 93 that is directly below an area where the IC substrate 74 is provided is in abutment contact with the bottom surface 99 of the guide groove 90. Thus, the part of the support plate 93 that is directly below the IC substrate 74 is supported by the bottom surface 99 of the guide groove 90.

Ink Supplying Device

Next the cartridge accommodating section 110 of the printer 10 will be described in detail with reference to FIGS. 1, 4 and 5. FIG. 1 shows how the ink cartridge 30 is fully mounted in the cartridge accommodating section 110.

As shown in FIG. 4, the cartridge accommodating section 110 is defined by a casing 101 formed with the opening 112 at a main side of the printer 10. The ink cartridge 30 is loaded in and unloaded from the casing 101 through the opening 112. Four ink cartridges 30 of cyan, magenta, yellow and black are loadable into four spaces formed in the casing 101, respectively. However, for explanatory purpose, FIG. 4 shows the casing 101 that has only one internal space for accommodating one ink cartridge 30 therein.

As shown in FIG. 4, the casing 101 includes an end wall 102 at a side opposite to the opening 112. A connecting portion 103 is provided at a bottom end portion of the end wall 102. The connecting portion 103 is aligned with the ink outlet portion 34 when the ink cartridge 30 is mounted in the casing 101.

The connecting portion 103 includes the ink needle 122 and a holding portion 121. The ink needle 122 is tubular shaped and is formed of a resin. Although not shown, an ink inlet port is formed at a tip end portion of the ink needle 122. The ink needle 122 is connected to the ink tube 20. The ink tube 20 connected to the ink needle 122 extends upward along the outer surface of the casing 101, and extends to the recording head 21 (see FIG. 1). In FIG. 4, the ink tube 20 is omitted.

The holding portion 121 is hollow cylindrical shaped, and the ink needle 122 coaxially provided in the holding portion 121. As shown in FIG. 6, upon loading the ink cartridge 30 into cartridge accommodating section 110, the ink outlet portion 34 is inserted into the inside of the holding portion 121 so that the front tip end of the ink outlet portion 34 abuts against the forwardmost or deepest end of the holding portion 121 and the outer peripheral side surface of the ink outlet portion 34 is hermetically contacted with the inner peripheral side surface of the holding portion 121. As a result of insertion of the ink outlet portion 34 into the holding portion 121, the ink needle 122 is inserted through the ink outlet opening 71, and pushes the valve 70 in the unloading direction 55 to open the valve 70. Thus, the ink accommodated in the ink chamber 36 can flow out of the ink chamber 36 into the ink needle 122 via the ink inlet port.

As shown in FIG. 4, the optical sensor 114 is provided on the end wall 102 at a position above the connecting portion 103 in the direction of gravitational force. The optical sensor 114 includes a light emitting element (LED, for example) and a light receiving element (phototransistor, for example). The light emitting element and the light receiving element are surrounded by housings, respectively, both of which cooperate to constitute a horseshoe-shaped outer shape of the entire optical sensor 114. The light emitting element and the light receiving element are confronting with each other in the horizontal direction orthogonal to the loading/unloading direction 50 (widthwise direction 51) by a predetermined distance in the horseshoe shaped housing. The light emitting element is configured to emit light in the horizontal direction orthogonal to the loading/unloading direction 50 (widthwise direction 51). The light receiving element is configured to receive the emitted light. The residual amount detection portion 33 of the ink cartridge 30 can enter into a space between the light emitting element and the light receiving element, so that the optical sensor 114 can detect changes in the amount of light that has transmitted through the residual amount detection portion 33.

As shown in FIG. 4, the casing 101 has a top wall 104. Three contact portions 106 are disposed on the top wall 104 at a location between the end wall 102 and the opening 112. The three contact portions 106 are arranged in a direction perpendicular to the loading/unloading direction 50 (widthwise direction 51) to be spaced away from one another. Positions of the three contact portions 106 correspond to those of the three electrodes 75 on the IC substrate 74, respectively, when the ink cartridge 30 is mounted in the cartridge accommodating section 110.

The contact portions 106 are formed of an electrically conductive material having a resiliency. The contact portions 106 are provided on the top wall 104 facing downwardly. The contact portions 106 are resiliently deformable upwardly in the vertical direction 52. The contact portions 106 are electrically connected to an arithmetic device (not shown) via electric circuits. The arithmetic device may be a device configured of a CPU, a ROM and a RAM, etc., or may be a control unit of the printer 10. When the HOT electrode 75 is electrically connected to the corresponding contact portion 106, a prescribed voltage Vc is applied to the HOT electrode 75. When the GND electrode 75 is electrically connected to the corresponding contact portion 106, the GND electrode 75 is electrically grounded. When the HOT electrode 75 and the GND electrode 75 are electrically connected to the corresponding contact portions 106, power is supplied to the IC (not shown) on the IC substrate 74. When the signal electrode 75 is electrically connected to the corresponding contact portion 106, data stored in the IC is rendered accessible. Outputs from the electric circuits are inputted to the arithmetic device.

An abutment surface 105 is formed at a portion of the casing 101 on the top wall 104 side. The abutment surface 105 is located on the end wall 102 side relative to the contact portions 106. The abutment surface 105 extends parallel to the end wall 102, and is disposed on the opening 112 side relative to the end wall 102. When the ink cartridge 30 is inserted into the cartridge accommodating section 110, the leading edge of the support plate 93, which is initially at the first position, first abuts against the abutment surface 105 as shown in FIG. 5, before the ink cartridge 30 reaches its target position (fully-loaded position) shown in FIG. 6. When the leading edge of the support plate 93 abuts against the abutment surface 105, the electrodes 75 on the IC substrate 74 are brought into electrical contact with the contact portions 106. Continuing insertion of the cartridge body 31 into the fully-loaded position causes the support plate 93 to move relative to the cartridge body 31, while maintaining the abutment contact between the support plate 93 and the abutment surface 105 and while maintaining electrical connection between the electrodes 75 and the contact portions 106. When the cartridge body 31 finally reaches the fully-loaded position and stops moving as will be described later with reference to FIG. 6, the front wall 40 abuts against the abutment surface 105 or just a small amount of space is left between the front wall 40 and the abutment surface 105.

As illustrated in FIG. 4, an engagement member 145 is provided in the casing 101. The engagement member 145 is provided for holding the ink cartridge 30 located in the cartridge accommodating section 110 in the fully-loaded state. The engagement member 145 is provided in the casing 101 at a location near to the upper edge of the opening 112.

More specifically, the engagement member 145 is plate-shaped extending in the vertical direction and in the loading/unloading direction 50, with its thickness in the horizontal direction perpendicular to the loading/unloading direction 50 (widthwise direction 51) being smaller than the widths of the guide groove 90 and the locking part 45 in the ink cartridge 30. The engagement member 145 has a support shaft 147 at its one end that is located on the opening 112 side. The support shaft 147 is attached to the casing 101 at the upper edge of the opening 112 so as to be rotatable about its central axis relative to the casing 101. The engagement member 145 pivots about the support shaft 147 relative to the casing 101 in directions to approach and separate away from the opening 112. In this way, the engagement member 145 is supported by the casing 101 so as to be pivotable about the support shaft 147. The engagement portion 145 has an engagement end portion 146 at its end opposite to the end at which the engagement member 145 is provided. The engagement end portion 146 is for being engaged with the locking part 45 of the ink cartridge 30. The engagement of the engagement end portion 146 with the locking part 45 holds the ink cartridge 30 in the fully-mounted state against the biasing force of the coil spring 84. A pivot position of the engagement member 145, indicated by a solid line in FIG. 4, is referred to as a locked position, at which the engagement end portion 146 is at a vertical level lower than or equal to an upper edge of the locking surface 46 and therefore the engagement end portion 146 can engage with the locking part 45. A pivot position of the engagement member 145, indicated by a broken line in FIG. 4, is referred to as an unlocked position, at which the engagement end portion 146 is at a vertical level higher than the upper edge of the locking surface 46 and therefore the engagement end portion 146 cannot engage with the locking part 45.

The engagement member 145 is configured to pivot, due to its own weight, about the support shaft 147 downward or clockwise in FIG. 4 to move from the unlocked position (indicated by a broken line) to the locked position (indicated by a solid line). When the leading end portion 81 of the pivotable member 80 is moved upward in the state that the ink cartridge 30 is mounted in the cartridge accommodating section 110, the engagement member 145 pivots upward or counterclockwise in FIG. 4 about the support shaft 147 to move from the locked position to the unlocked position. Although not illustrated in the drawings, the engagement member 145 is restricted from pivoting further downward or clockwise from the locked position indicated by the solid line in FIG. 4.

Loading and Unloading of the Ink Cartridge

Next, how the ink cartridge 30 is mounted in and removed from the cartridge accommodating section 110 will be described with reference to FIGS. 5 through 6.

Before the ink cartridge 30 is mounted in the cartridge accommodating section 110, the support plate 93 is located at the first position as shown in FIGS. 2 and 3. So, when the ink cartridge 30 is inserted into the cartridge accommodating section 110 in the loading direction 56, as the ink cartridge 30 moves toward the end wall 102, the engagement end portion 146 first runs on the support plate 93 and then runs on the coil spring 84 as shown in FIG. 5.

Figure 5:
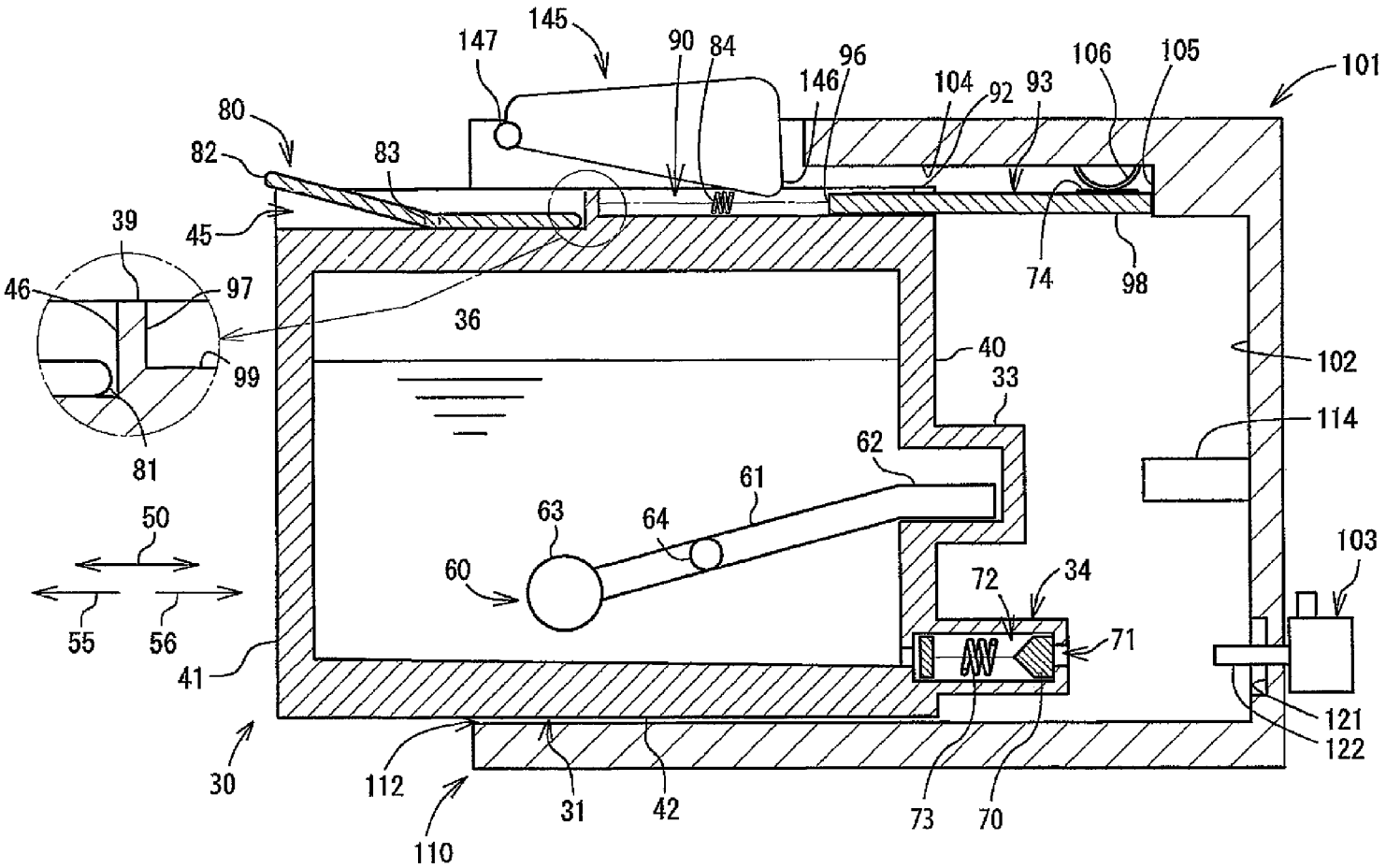

Then, the leading end of the support plate 93 abuts against the abutment surface 105 of the casing 101 as shown in FIG. 5. At this timing, the electrodes 75 on the IC substrate 74 are brought into contact with the contact portions 106. So, the electrodes 75 and contact portions 106 are brought into electrical connection with each other. The cartridge body 31 is further pushed toward the end wall 102, while the support plate 93 abutting against the abutment surface 105. As a result, relative movement between the support plate 93 and the cartridge body 31 in the depthwise direction 53 starts. That is, the support plate 93 starts moving relative to the cartridge body 31 toward the rear-side terminal end surface 97 of the guide groove 90 against the biasing force of the coil spring 84. As a result, the support plate 93 slidingly moves relative to the cartridge body 31 from the first position to the second position.

The ink outlet portion 34 of the ink cartridge 30 enters the inside of the holding portion 121, while the ink needle 122 enters the ink outlet opening 71 and contacts the ink supply valve 70. As the cartridge body 31 further moves in the loading direction 56, the ink needle 122 pushes the ink supply valve 70 in the unloading direction 55 and separates the ink supply valve 70 from the ink outlet opening 71 against the biasing force of the coil spring 73. When the tip end of the ink outlet portion 34 contacts the forwardmost or deepest end of the holding portion 121 as shown in FIG. 6, the cartridge body 31 is fixed in position relative to the casing 101 of the cartridge accommodating section 110. At this timing, movement of the cartridge body 31 stops, and the ink cartridge 30 is finally located in the target, fully-mounted position. As a result, ink flows out of the ink chamber 36 into the ink needle 122.

When the cartridge body 31 reaches the fully-mounted position, the residual amount detection portion 33 of the ink cartridge 30 reaches the detecting position by the optical sensor 114 so that the indicator 62 of the sensor arm 60 can be detected by the optical sensor 114.

It is noted that immediately before the ink cartridge 30 reaches the fully-mounted position, the engagement end portion 146 that has run on the coil spring 84 reaches part of the upper wall 39 between the guide groove 90 and the locking part 45 in the loading/unloading direction 50. At this timing, the engagement member 145 pivots counterclockwise in FIG. 5 to move from the locked position to the unlocked position and becomes supported by the upper wall 39. Thereafter, the cartridge body 31 further moves in the loading direction 56 to the fully-mounted position. As a result, the engagement end portion 146 separates away from this part of the upper wall 39 in the unloading direction 55. As a result, the engagement end portion 146 becomes free from support by the upper wall 39, and the engagement member 145 pivots clockwise in FIG. 6 to the locked position. The engagement end portion 146 is brought into contact with the locking surface 46. The engagement member 145 becomes engaged with the locking part 45 to hold the cartridge body 31 at the fully-mounted position against the biasing force of the coil spring 84. In the manner described above, the loading of the ink cartridge 30 to the cartridge accommodating section 110 is completed.

When the cartridge body 31 is at the fully-mounted position as shown in FIG. 6, the support plate 93 is positioned at the second position with its leading edge being in abutment contact with the abutment surface 105. Almost the entire portion of the lower surface 98 of the support plate 93 is in abutment contact with the bottom surface 99 of the guide groove 90. So, a portion of the lower surface 98 that is positioned right below the IC substrate 74 is in abutment contact with the bottom surface 99. So, while the electrodes 75 are contacted by the contact portions 106 from above by a predetermined amount of contact pressure that is directed downward, the IC substrate 74 and support plate 93 are fully supported by the main casing 31 from below against the contact pressure.

The information retrieved from the IC of the IC substrate 74 through the corresponding contact portions 106 is used for determining the type of the mounted ink cartridge 30 (color of ink, capacity of ink and so on) at the printer 10. Determination of the type of mounted ink cartridge 30 can be made by using conventional methods, and therefore detailed explanation therefor will be omitted here.

In a state where the ink cartridge 30 is at the fully-mounted position in the cartridge accommodating section 110, the leading end portion 81 of the pivotable member 80 is positioned below the engagement end portion 146 of the engagement member 145. Further, the rear end portion 82 of the pivotable member 80 is separate away from the bottom surface of the locking part 45 and located above the upper surface of the upper wall 39 of the cartridge body 31.

When the ink in the ink chamber 36 is used up, the used ink cartridge 30 is unloaded from the cartridge accommodating section 110 to be replaced with a new ink cartridge 30.

In order to unload the ink cartridge 30 from the cartridge accommodating section 110, the rear end portion 82 of the pivotable member 80 is pushed down by a user. As a result, the leading end portion 81 of the pivotable member 80 moves upward and is separated from the bottom surface of the locking part 45. The engagement member 145 is pushed upward by the leading end portion 81 of the pivotable member 80. As a result, the engagement member 145 pivots to such a degree that the engagement end portion 146 is positioned above the upper edge of the locking surface 46 so as to be separated from the locking surface 46. That is, the engagement member 145 pivots from the locked position to the unlocked position to release the holding of the ink cartridge 30 by the engagement member 145.

Upon separation of the engagement member 145 from the locking surface 46, the cartridge body 31 moves in the unloading direction 55 due to the external force applied to the cartridge body 31, that is, the biasing force of the coil spring 84.

The movement of the cartridge body 31 in the unloading direction 55 causes the support plate 93 to slidingly move relative to the cartridge body 31 from the second position to the first position. The movement of the cartridge body 31 in the unloading direction 55 further causes the ink needle 122 to separate from the ink outlet portion 34. The IC substrate 74 continues contacting the contact portions 106 until the ink needle 122 is separated from the ink outlet portion 34. The IC substrate 74 is separated from the contact portions 106 after the ink needle 122 is separated from the ink outlet portion 34.

Effects of the First Embodiment

According to the first embodiment, the front wall 40 faces forwardly, that is, in the loading direction 56. The ink outlet portion 34 has the ink outlet opening 71 at the front wall 40, and is configured to be connected with the ink needle 122 and to direct ink from the ink chamber 36 to the ink needle 122. The support plate 93 supporting the IC substrate 74 is provided at the external surface of the cartridge body 31 so as to be movable relative to the cartridge body 31 between the first position and the second position in the loading/unloading direction (front/rear direction) 50. When the support plate 93 is at the second position, the cartridge body 31 supports the support plate 93 and the IC substrate 74 against contact pressure that is applied to the IC substrate 74 from the contact portions 106.

With this configuration, when the ink cartridge 30 is mounted in the cartridge accommodating section 110, the ink outlet portion 34 is brought into fluid connection or fluid communication with the ink needle 122, and the IC substrate 74 is brought into electrical connection with the contact portions 106. Because the support plate 93 is movable between the first and second positions in the front/rear direction 50, the timings when the ink outlet portion 34 is brought into and out of fluid connection with the ink needle 122 can be differentiated from the timings when the IC substrate 74 is brought into and out of electrical connection with the contact portions 106. So, even if ink scatters upon connection/disconnection of the ink outlet portion 34 with the ink needle 122, the ink is unlikely to adhere to the IC substrate 74.

The support plate 93 is provided at the top wall 39 and moves between the first and second positions. When the support plate 93 is at the first position, the IC substrate 74 is located on the front side of the ink outlet opening 71. When the support plate 93 is at the second position, the IC substrate 74 is located on the rear side of the ink outlet opening 71 and supported by the cartridge body 31.

Accordingly, the IC substrate 74 is brought into contact with the contact portions 106 before the ink needle 122 is inserted into the ink outlet opening 71. So, even if ink scatters when the ink needle 122 is inserted into the ink outlet opening 71, the ink is unlikely to adhere to the IC substrate 74 or contact portions 106. Further, the IC substrate 74 continues contacting the contact portions 106 until the ink needle 122 is separated from the ink outlet opening 71. The IC substrate 74 is separated from the contact portions 106 after the ink needle 122 is separated from the ink outlet opening 71. So, even if ink scatters when the ink needle 122 is separated from the ink outlet opening 71, the ink is unlikely to adhere to the IC substrate 74 or contact portions 106.

The support plate 93 supporting the IC substrate 74 thereon moves relative to the cartridge body 31 in the loading/unloading direction 50. So, the IC substrate 74 can be easily moved relative to the cartridge body 31.

The support plate 93 is located at a position different from the residual amount detection portion 33 in the vertical direction 52, which is orthogonal to both of the loading/unloading direction 50 and the direction in which the light travels (widthwise direction 51). So, the movement of the support plate 93 does not obstruct the light from entering the residual amount detection portion 33.

While the ink cartridge 30 is being folly mounted in the cartridge accommodating section 110, the support plate 93 is maintained at the second position through abutment contact of the support plate 93 with the abutment surface 105 of the cartridge accommodating section 110. The IC substrate 74 is unlikely shifted from the contact portions 106. This maintains electrical connection between the IC substrate 74 and contact portions 106.

The coil spring 84 resiliently urges the support plate 93 in the loading direction 56, that is, in the direction from the second position toward the first position. This prevents the support plate 93 from staying at the second position when, the ink cartridge 30 is unloaded from the cartridge accommodating section 110.

The ink outlet portion 34 is located at the bottom wall 42 side of the cartridge body 31, while the IC substrate 74 is located at the top wall 39 side. So, when the ink cartridge 30 is unloaded from the cartridge accommodating section 110, ink is unlikely deposited on the IC substrate 74.

In particular, in the first embodiment, the support plate 93 supporting the IC substrate 74 is fitted into the guide groove 90. So, when the support plate 93 is moved along the depthwise direction 53, both ends of the support plate 93 in the widthwise direction 51 are guided by the inner walls of the guide groove 90, allowing the support plate 93 to smoothly move.

Although the protruding pieces 91 and 92 for abutting against the abutment surface portions 94 and 95, respectively, are formed in the first embodiment, the protruding pieces 91 and 92 may be omitted. That is, the first position of the support plate 93 may be determined by the natural length of the coil spring 84. Further, the guide groove 90 may be omitted and, in this case, the support plate 93 may be supported on the upper surface of the upper wall 39 of the cartridge body 31.

Second Embodiment

An ink cartridge 130 according to a second embodiment of the present invention will be described with reference to FIGS. 7 to 9. In the first embodiment, the support plate 93 is slid frontward from the front wall 40 of the cartridge body 31; while in the second embodiment, a support plate 132 is slid rearward from the rear wall 41 of a cartridge body 31 of the ink cartridge 130. The ink cartridge 130 according to the second embodiment differs from the ink cartridge 30 according to the first embodiment in that the support plate 132 is mounted to the cartridge body 31 in place of the support plate 93. The configurations of the residual amount detection portion 33, ink outlet portion 34, IC substrate 74, and pivotable member 80 are the same as those of the first embodiment, so that detailed descriptions thereof will be omitted by giving the same reference numerals as those of the first embodiment to such parts.

Figure 8:
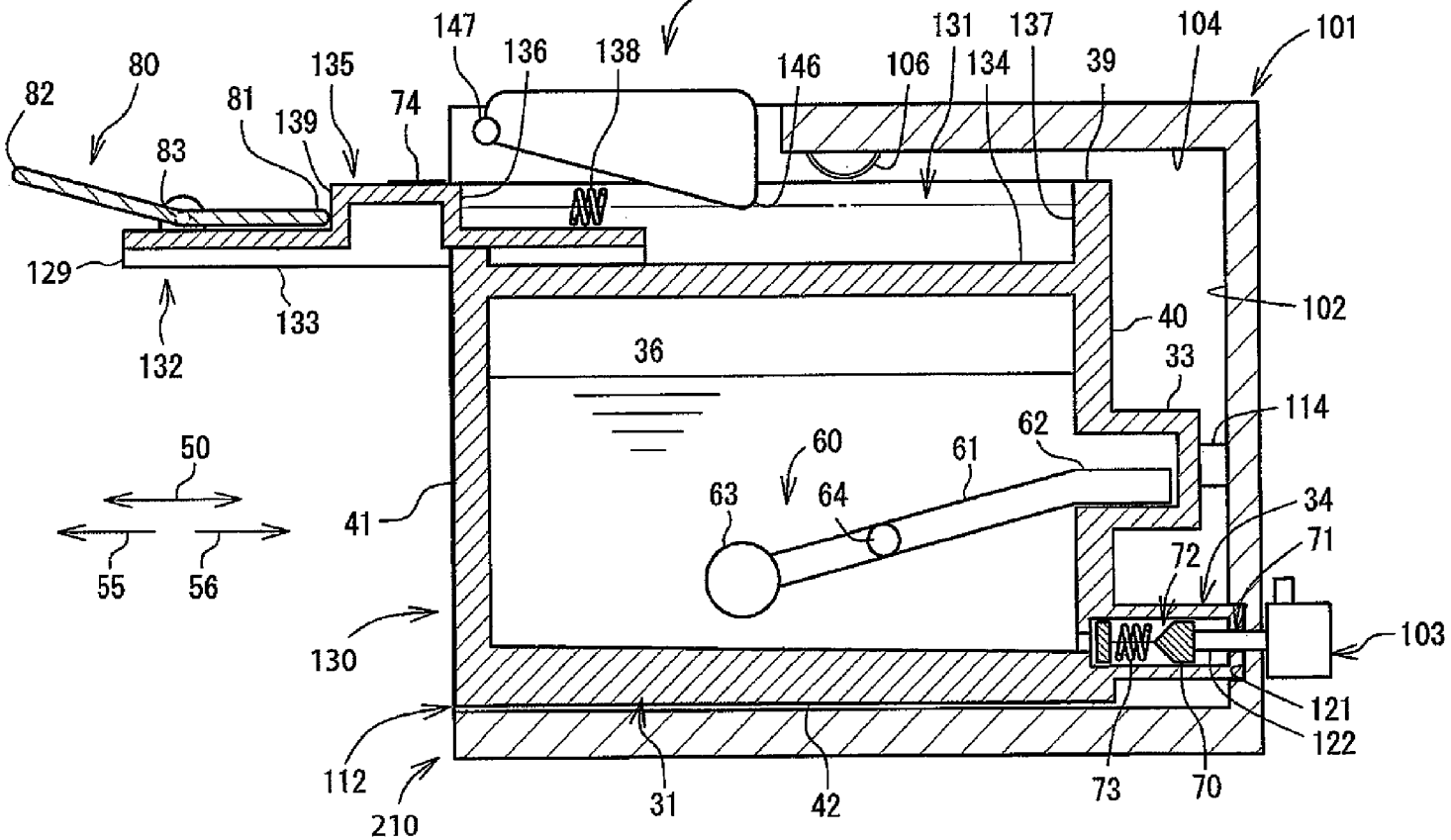

The ink cartridge 130 according to the second embodiment is loaded in a cartridge accommodating section 210 according to the second embodiment as shown in FIG. 8. The cartridge accommodating section 210 according to the second embodiment is the same as the cartridge accommodating section 110 according to the first embodiment except that the cartridge accommodating section 210 does not have the abutment surface 105 and the cartridge accommodating section 210 has the contact portions 106 at a location nearer to the opening 112 than the cartridge accommodating section 110.

Figure 7:
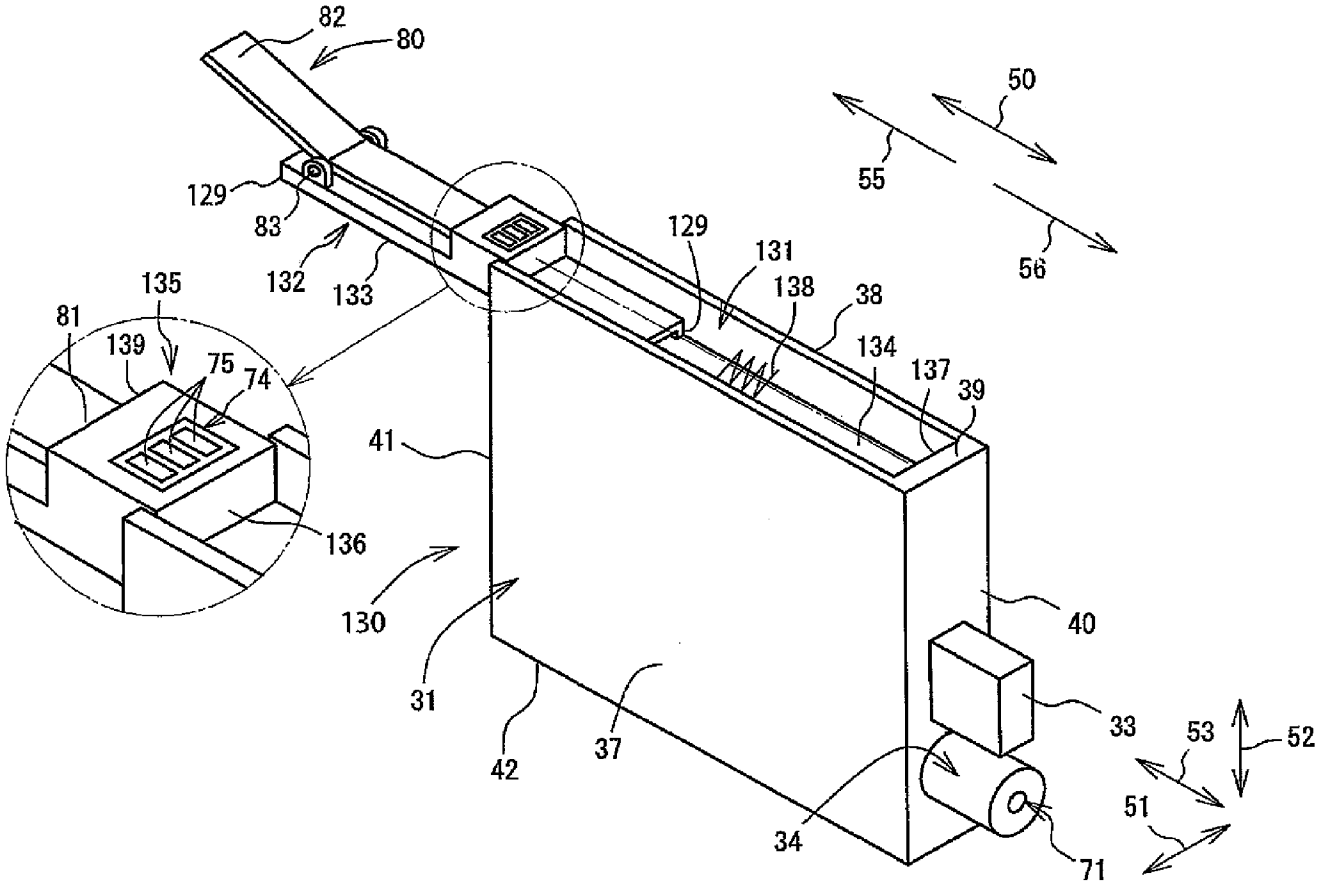
FIG. 7 is a perspective view showing an external configuration of an ink cartridge according to a second embodiment.

As illustrated in FIG. 7, a guide groove 131 extending from near the front wall 40 to the rear wall 41 is formed in the upper wall 39 of the cartridge body 31. The guide groove 131 is positioned above the residual amount detection portion 33 in the height direction 52. The guide groove 131 is concaved downward from the upper wall 39, extends along the depthwise direction 53, and opens in the rear wall 41. The guide groove 131 has a bottom surface 134 facing upwardly, and a front-side terminal end surface 137 at its front edge. The front-side terminal end surface 137 faces rearwardly, that is, in the unloading direction 55.

The support plate 132 is fitted into the guide groove 131. The support plate 132 is formed into substantially a flat-plate shape. A pair of ribs 129 are formed on a lower surface of the support plate 132. The ribs 129 extend along the widthwise edges of the support plate 132. The ribs 129 extend over the entire length of the support plate 132 in the depthwise direction 53. The ribs 129 protrude from the lower surface of the support plate 132 downward in the vertical direction 52. The ribs 129 have tip end surfaces or lower surfaces 133 that face downward in the vertical direction 52. The support plate 132 can be slid along the depthwise direction 53 with the lower surfaces 133 of the ribs 129 being brought into sliding contact with the bottom surface 134 of the guide groove 131.

A support portion 135 protrudes upward from a generally intermediate portion of the support plate 132 in the depthwise direction 53. An upper surface of the support portion 135 is substantially flush with the upper surface of the upper wall 39 in the height direction 52. The IC substrate 74 is supported on the upper surface of the support portion 135. The support portion 135 has a front surface 136 facing forwardly, that is, in the loading direction 56. The support portion 135 has a rear surface 139 facing rearwardly, that is, in the unloading direction 55.

A coil spring 138 is provided in the guide groove 131 to extend between the front surface 136 of the support portion 135 and the front-side terminal end surface 137 of the guide groove 131. The coil spring 138 is resiliently contractable in the depthwise direction 53. The support plate 132 is urged by the coil spring 138 in the unloading direction 55. In a state where no external force other than the biasing force of the coil spring 138 is applied to the support plate 132, the support plate 132 protrudes rearward from the rear wall 41 of the cartridge body 31 (first position) as shown in FIGS. 7 and 8. When external force is applied onto the support plate 132 in a direction to bring the support plate 132 in the loading direction 56 toward the front-side terminal end surface 137 of the guide groove 131, the coil spring 138 is resiliently contracted and the support plate 132 is slid toward the front-side terminal end surface 137 of the guide groove 131 and reaches a second position. When the support plate 132 reaches the second position, the IC substrate 74 is brought into electrical contact with the contact portions 106 in the cartridge accommodating section 210 (see FIG. 9). That is, the second position is located on the front wall 40 side relative to the first position. As described above, the support plate 132 can reciprocate between the first and second positions in accordance with the expansion/contraction of the coil spring 138.

The pivotable member 80 is provided on the support plate 132 at a location rearward of the rear surface 139 of the support portion 135. When the pivotable member 80 is pivoted to such a degree that the leading end portion 81 reaches an uppermost position, the leading end portion 81 reaches a vertical level higher than the upper edge of the rear surface 139 of the support portion 135.

Before the ink cartridge 130 is loaded in the cartridge accommodating section 210, the support plate 132 is located at the first position as shown in FIGS. 7 and 8. As illustrated in FIG. 8, when the ink cartridge 130 is inserted into the cartridge accommodating section 210 in the loading direction 56, the engagement end portion 146 of the engagement member 145 rides on the upper wall 39 on the front edge of the ink cartridge 130 and then runs on the coil spring 138.

Then, the ink outlet portion 34 of the ink cartridge 130 enters the inside of the holding portion 121, while the ink needle 122 enters the ink outlet opening 71 and contacts the ink supply valve 70. As the cartridge body 31 moves in the loading direction 56, the ink needle 122 pushes the ink supply valve 70 in the unloading direction 55 and separates the ink supply valve 70 from the ink outlet opening 71 against the biasing force of the coil spring 73. When the tip end of the ink outlet portion 34 contacts the forwardmost or deepest end of the holding portion 121 as shown in FIG. 9, the cartridge body 31 is fixed in position relative to the casing 101 of the cartridge accommodating section 210. At this timing, movement of the cartridge body 31 stops, and the ink cartridge 130 is finally located in the target, fully-mounted position. As a result, ink flows out of the ink chamber 36 into the ink needle 122. When the ink cartridge 130 thus reaches the fully-mounted position, the residual amount detection portion 33 of the ink cartridge 130 reaches the detecting position by the optical sensor 114 so that the indicator 62 of the sensor arm 60 can be detected by the optical sensor 114.

After the ink cartridge 130 is thus fixed in the fully-mounted position, as shown in FIG. 8, a user further pushes the support plate 132 in the loading direction 56. As a result, movement of the support plate 132 relative to the cartridge body 31 in the depthwise direction 53 starts. That is, the support plate 132 is pushed in the loading direction 56 toward the front-side terminal end surface 137 side of the guide groove 131 against the biasing force of the coil spring 138. As a result, the support plate 132 is slid relative to the cartridge body 31 from the first position to the second position.

Figure 9:
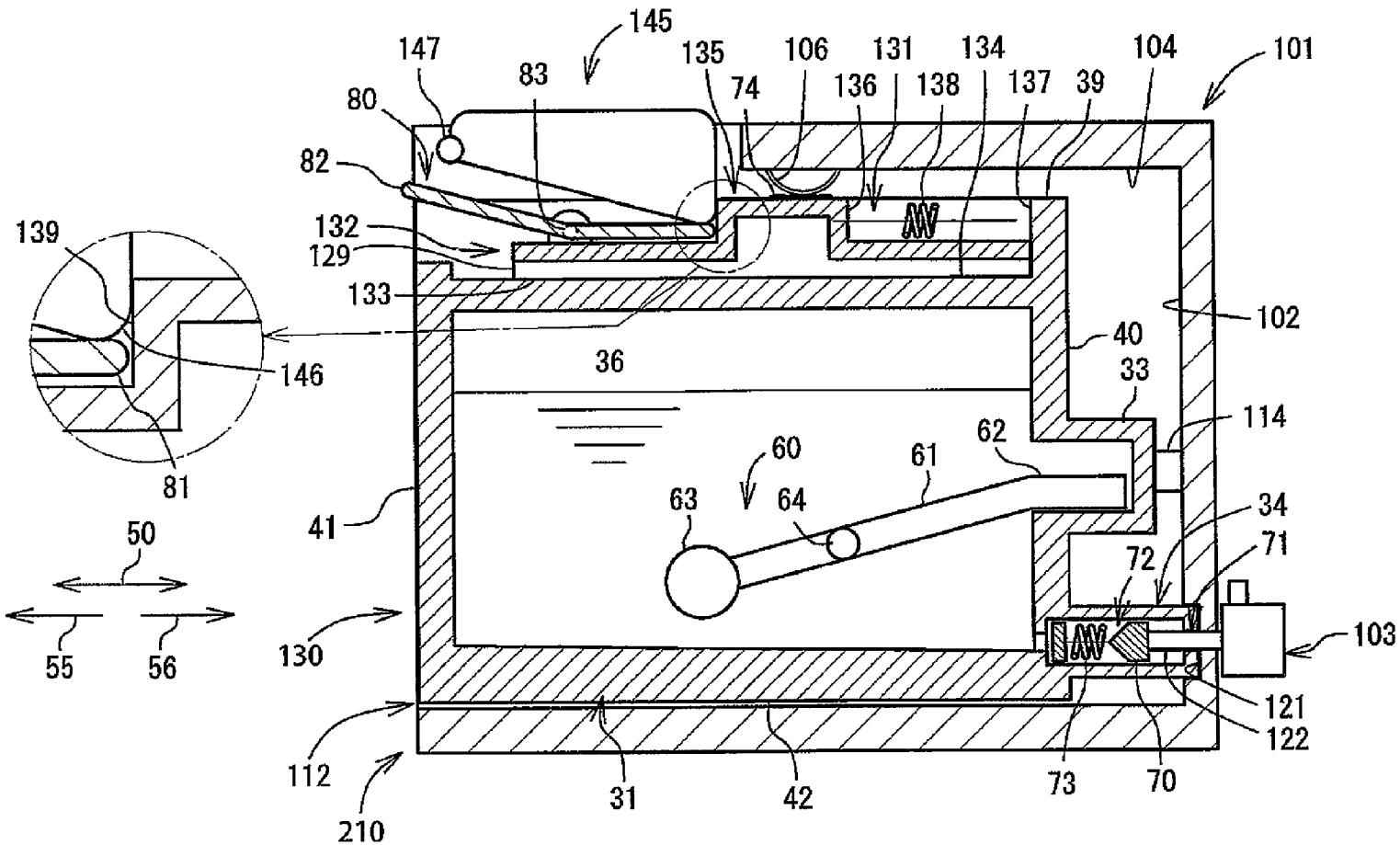

As illustrated in FIG. 9, when the support plate 132 reaches the second position, the electrodes 75 of the IC substrate 74 are brought into contact with the contact portions 106. In this way, the electrodes 75 of the IC substrate 74 are brought into electrical connection with the contact portions 106. At this timing, the entire length of the support plate 132 in the depthwise direction 53 (loading/unloading direction 50) becomes accommodated in the guide groove 133. So, the entire portions of the lower surfaces 133 of the ribs 129 are in abutment contact with the bottom surface 134 of the guide groove 131. So, portions of the lower surfaces 133 that are positioned right below the support portion 135 are in abutment contact with the bottom surface 134, and are supported by the bottom surface 134. The support portion 135 supports the IC substrate 74 thereon. So, while the electrodes 75 on the IC substrate 74 are contacted by the contact portions 106 from above by a predetermined amount of contact pressure that is directed downward, the IC substrate 74 and support plate 132 are fully supported by the main casing 31 from below against the contact pressure.

It is noted that immediately before the support plate 132 reaches the second position, the engagement end portion 146 of the engagement member 145 that has run on the coil spring 138 reaches the support portion 135. At this timing, the engagement member 145 is pivoted in the counterclockwise direction in FIG. 8 from the locked position to the unlocked position and becomes supported by the support portion 135. Thereafter, as the support plate 132 further moves in the loading direction 56 to the second position, the engagement end portion 146 separates away from the support plate 132 in the unloading direction 55. As a result, the engagement end portion 146 becomes free from support by the support portion 135, and the engagement member 145 is pivoted clockwise in FIG. 9 to the locked position. The engagement end portion 146 is brought into contact with the rear surface 139 of the support portion 135. As a result, the support plate 132 is held at the second position against the biasing force of the coil spring 138. In the manner described above, the attachment of the ink cartridge 130 to the cartridge accommodating section 210 is completed.

When the ink in the ink chamber 36 is used up, the used ink cartridge 130 is unloaded from the cartridge accommodating section 210 to be replaced with a new ink cartridge 130.

In order to unload the ink cartridge 130 from the cartridge accommodating section 210, the rear end portion 82 of the pivotable member 80 is pushed down by a user. As a result, the leading end portion 81 of the pivotable member 80 is moved upward, and the engagement member 145 is pivoted to such a degree that the engagement end portion 146 is positioned above the upper edge of the rear surface 139 of the support portion 135 so as to be separated from the rear surface 139. That is, the engagement member 145 is pivoted from the locked position to unlocked position to release the holding of the ink cartridge 130 by the engagement member 145.

Upon separation of the engagement member 145 from the rear surface 139, the support plate 132 moves in the unloading direction 55 by external force applied to the support plate 132, that is, the biasing force of the coil spring 138 to reach the first position. The IC substrate 74 is also moved, together with the support plate 132, in the unloading direction 55 to separate from the contact portions 106. At this time, the ink needle 122 is still being inserted in the ink outlet portion 34.

After that, the cartridge body 31 is pulled in the unloading direction 55 by the user, and the ink needle 122 is separated from the ink outlet portion 34. At this time, the IC substrate 74 is disposed furthest rearward from the ink outlet portion 34.

Effects of the Second Embodiment

According to the second embodiment, because the support plate 132 is configured to move relative to the cartridge body 31, timings at which the IC substrate 74 is brought into and out of contact with the contact portions 106 can be differentiated from timings at which the ink needle 122 is inserted into and separated from the ink outlet portion 34.

More specifically, the support plate 132 supporting the IC substrate 74 is provided at the top wall 39, and moves between the first and second positions. When the support plate 132 is at the first position, the IC substrate 74 is located on the rear side of the rear wall 41. When the support plate 132 is at the second position, the IC substrate 74 is located on the front side of the rear wall 41 and supported by the cartridge body 31.

With this configuration, after the ink needle 122 is inserted into the ink outlet opening 71, the electrodes 75 are brought into contact with the contact portions 106. After the electrodes 75 are separated from the contact portions 106, the ink needle 122 is separated from the ink outlet opening 71. So, the IC substrate 74 is disposed furthest rearward from the ink outlet opening 71 when the ink needle 122 is inserted into and separated from the ink outlet opening 71. So, even if ink scatters upon insertion/separation of the ink needle 122 into/from the ink outlet opening 71, the ink is unlikely to adhere to the IC substrate 74.

The support plate 132 supporting the IC substrate 74 thereon moves relative to the cartridge body 31 in the loading/unloading direction 50. So, the IC substrate 74 can be easily moved relative to the cartridge body 31.

The support plate 132 is guided by the guide groove 131 to move in the loading/unloading direction 50. So, the support plate 132 can smoothly move in the loading/unloading direction 50.

While the ink cartridge 130 is being fully mounted in the cartridge accommodating section 210, the support plate 132 is locked at the second position through engagement of the engagement member 145 with the rear surface 139. This ensures that the ink cartridge 130 is locked at the fully-mounted position in the cartridge accommodating section 210.

In order to unload the ink cartridge 130 from the cartridge accommodating section 210, a user operates the pivotable member 80 to release engagement of the engagement member 145 out of the rear surface 139. This can release the locked state of the ink cartridge 130.

Modifications

Although the support plate 93 or 132 is biased by the coil spring 84 or 138 in the above embodiments, the coil spring 84 or 138 may be omitted. For example, a configuration may be possible in which before use of the ink cartridge 30 or 130, the support plate 93 or 132 is set at the first position in a state of being engaged with the cartridge body 31 by an easily engageable/removable engagement mechanism and, in a process where the ink cartridge 30 or 130 is loaded into the cartridge accommodating section 110 or 210, engagement of the engagement mechanism is released to cause the support plate 93 or 132 to move from the first position to second position. Even such a configuration can make it unlikely for the ink scattering upon insertion of the ink needle 122 into the ink outlet portion 34 to adhere to the IC substrate 74.

Further, although the support plate 93 or 132 is provided on the upper wall 39 side of the cartridge body 31 in the above embodiments, the support plate 93 or 132 may be formed into a cover shape covering the upper wall 39, side walls 37, 38, and the like of the cartridge body 31.

An ink cartridge 230 according to a modification of the second embodiment will be described with reference to FIGS. 10 and 11.

The ink cartridge 230 according to this modification is different from the ink cartridge 130 of the second embodiment in that the ink cartridge 230 employs a support member 140 having substantially a rectangular parallelepiped shape, in place of the plate-shaped support plate 132, and in that a cartridge body 31 of the ink cartridge 230 is formed with a guide space 231 capable of accommodating the support member 140, in place of the guide groove 131. The configurations of the ink chamber 36, the residual amount detection portion 33, ink outlet portion 34, IC substrate 74, coil spring 138, and pivotable member 80 are the same as those of the second embodiment, so that detailed descriptions thereof will be omitted by giving the same reference numerals as those of the second embodiment to such parts.

More specifically, the support member 140 is formed into a box shape. A lower portion of a rear wall 143 of the support member 140 is curved so as to be easily pushed by a user. Guides 142 extending in the depthwise direction 53 are formed on both side surfaces of the support member 140 in the widthwise direction 51.

The internal space between the side walls 37 and 38 is partitioned by an upper partition wall 234 and a rear partition wall 43, both of which extend in the widthwise direction 51 and connect the inner side surfaces of the side walls 37 and 38 in the widthwise direction 51. The upper partition wall 234 extends from the front wall 40 in the unloading direction 55, and the rear partition wall 43 extends downwardly from the rear edge of the upper partition wall 234. The guide space 231 is formed at a rear and upper side of the upper partition wail 234 and the rear partition wall 43. The ink chamber 36 (see FIG. 11) is provided in the front and lower side of the upper partition wall 234 and the rear partition wall 43.

Grooves 141 are formed in the inner surfaces of the side walls 37 and 38 in the widthwise direction 51. The grooves 141 are concaved from the inner surfaces of the side walls 37 and 38 outward in the widthwise direction 51. The grooves 141 extend in the depthwise direction 53. The support member 140 is supported by the main casing 31, with the guides 142 on the support member 140 being slidably fitted in the grooves 141 on the side walls 37 and 38, respectively. Thus, the support member 140 is slidably accommodated in the guide space 231.

The coil spring 138 is provided in the upper portion of the guide space 231 to extend in the depthwise direction 53. One end of the coil spring 138 is connected to an upper portion of a front surface 236 of the support member 140, and the other end of the coil spring 138 is connected to a front-side terminal end surface 237 of the guide space 231 in the cartridge body 31.

Figure 10:
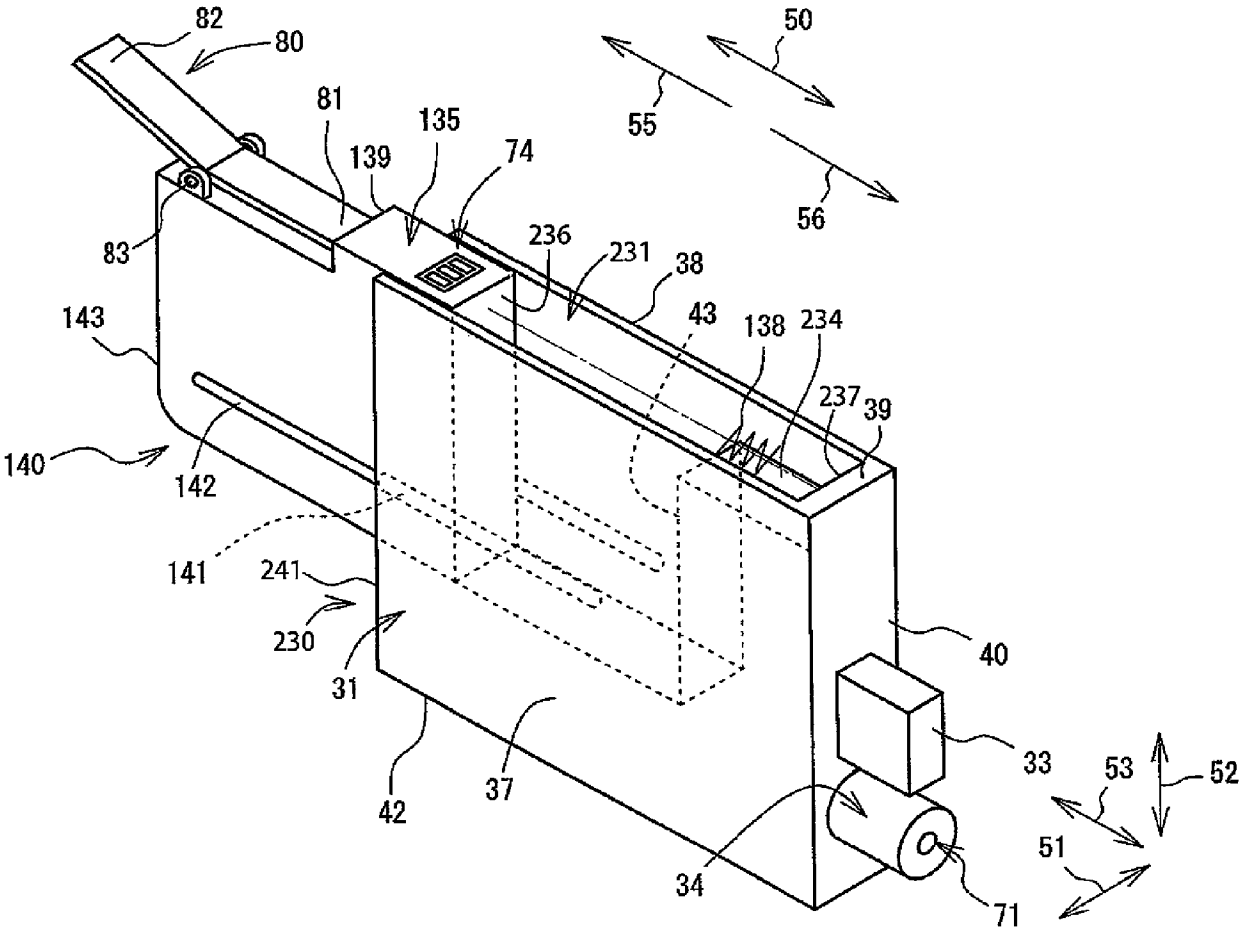

With the above-described configuration, when the length of the coil spring 138 is the natural length of the coil spring 138, the support member 140 is disposed on the rear side as shown in FIG. 10 (first position). When a user pushes the support member 140 frontward against the biasing force of the coil spring 138, the support member 140 is moved in the loading direction 56 relative to the cartridge body 31 to the second position shown in FIG. 11, while being guided by the grooves 141.

According to this modification, the movement of the support member 140 can be guided by the inner surfaces of the side walls 37 and 38 that have large amounts of surface areas. This ensures that the support member 140 moves stably relative to the cartridge body 31 of the ink cartridge 230.

Thus, according to this modification, part of each of the side walls 37 and 38 that is located to the rear of the ink chamber 36 serves as a guide for the box-shaped support member 140. The ink chamber 36 is disposed frontward of the support member 140, while the support member 140 is at any location between the first and second positions. Thus, the ink chamber 36 does not overlap the support member 140 in the depthwise direction 53.

When the support member 140 is located at any position between the first and second positions, the IC substrate 74 is disposed frontward of the rear edges 241 of the side walls 37 and 38, but is disposed rearward of the rear partition wall 43 that is disposed rearward of the ink chamber 36. Thus, according to this modification, when the support member 140 is located at the first position, the IC substrate 74 is disposed frontward of the rear edges 241 of the side walls 37 and 38. This is in contrast to the second embodiment, in which when the support plate 132 is located at the first position, the IC substrate 74 is disposed rearward of the rear wall 41 of the cartridge body 31.

Figure 11:
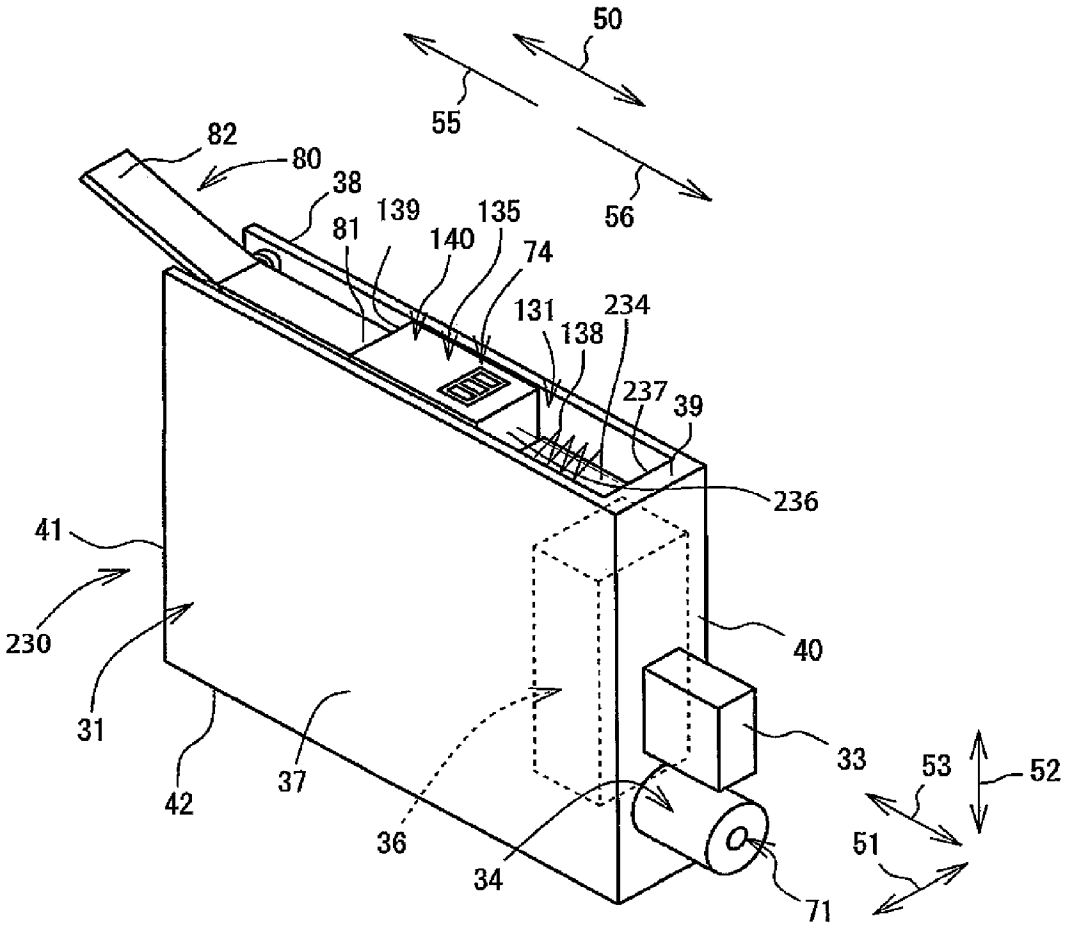

The above-described modification shows that in the case where parts of the side walls 37 and 38 serve as a guide for the support member 140 having substantially a rectangular parallelepiped shape and where the ink chamber 36 is disposed frontward of the support member 140 being at the second position as illustrated in FIG. 11, the IC substrate 74 may be disposed frontward of the rear side edges 241 of the side walls 37 and 38 serving as the guide, provided that the IC substrate 74 is disposed rearward of the rear partition wall 43, which is on the rear side of the ink chamber 36.

In the above-described modification, the ink chamber 36 is disposed on the front wall 40 side of the cartridge body 31 and does not overlap the support member 140 in the depthwise direction 53 as shown in FIG. 11. However, the ink chamber 36 may be formed to extend rearwardly or in the unloading direction 55 to a portion below the support member 140.

While the invention has been described in detail with reference to the embodiment thereof, it would be apparent to those skilled in the art that various changes and modifications may be made therein without departing from the spirit of the invention.

For example, in the first embodiment, when the support plate 93 is at the second position, almost the entire length of the support plate 93 in the depthwise direction 53 is accommodated in the guide groove 90. So, the portion of the support plate 93 that is positioned right under the IC substrate 74 is entirely supported by the bottom surface 99 of the guide groove 90. However, the portion of the support plate 93 right under the IC substrate 74 may not be entirely supported by the bottom surface 99 of the guide groove 90. For example, when the support plate 93 is at the second position, only a rear side part of the support plate 93 in the depthwise direction 53 may be accommodated in the guide groove 90 so that only a rear part of the IC substrate 74 in the depthwise direction 53 is placed in the guide groove 90. The other remaining front side part of the support plate 93 protrudes forwardly from the front wall 40 with the other remaining front part of the IC substrate 74. In this case, out of the portion of the support plate 93 that is right under the IC substrate 74, only a rear part is supported by the bottom surface 99 of the guide groove 90. Still in this case, the cartridge body 31 can stably support the IC substrate 74 against the contact pressure from the contact portions 106.

In the second embodiment, the ribs 129 are provided over the entire length of the support plate 132 in the depthwise direction 53. So, the ribs 129 exist right below the support portion 135. However, it is unnecessary that the ribs 129 are provided over the entire length of the support plate 132. For example, the ribs 129 may not be provided right below the support portion 135. The cartridge body 31 can stably support the IC substrate 74 against the contact pressure from the contact portions 106, even though the ribs 129 are not provided right below the support portion 135.

What is claimed is:

1. A print fluid cartridge comprising:

a main body having a first surface and a second surface, the first surface facing in a first direction, the second surface being located upstream of the first surface in the first direction, the main body further having a chamber configured to store print fluid at a position between the first surface and the second surface;

a print fluid outlet part provided on the main body, having an opening at the first surface, and configured to direct the print fluid from the chamber to an exterior of the main body; and an electric interface provided at an external surface of the main body and facing in a second direction that is orthogonal to the first direction, the electric interface being configured to move relative to the main body in the first direction and in a direction opposite to the first direction between a first position and a second position that are apart from each other in the first direction and the direction opposite to the first direction, the main body being configured to support the electric interface at the second position against pressure that is applied to the electric interface from outside the print fluid cartridge in a direction opposite to the second direction.

2. The print fluid cartridge according to claim 1, wherein the main body further has a third surface and a fourth surface, the fourth surface facing in the second direction, the third surface being located upstream of the fourth surface in the second direction, the electric interface being located at the fourth surface, the print liquid outlet part being located at an upstream side of the electric interface in the second direction.

3. The print fluid cartridge according to claim 1, wherein the electric interface is provided at an external surface of the main body that is other than the first surface and the second surface, the electric interface being located on a downstream side of the opening of the print fluid outlet part in the first direction when the electric interface is at the first position, the electric interface being located on an upstream side of the opening of the print fluid outlet part in the first direction and supported by the main body when the electric interface is at the second position.

4. The print fluid cartridge according to claim 3, further comprising an urging member configured to resiliently urge the electric interface in the first direction from the second position toward the first position.

5. The print fluid cartridge according to claim 3, wherein the main body is provided with a supporting member that is configured to move relative to the main body in the first direction and in the direction opposite to the first direction and to support the electric interface.

6. The print fluid cartridge according to claim 5, wherein the main body includes a signal attenuating part configured to attenuate a signal received from outside the print fluid cartridge, the supporting member being located at a position different from the signal attenuating part in the second direction.

7. The print fluid cartridge according to claim 5, wherein the supporting member is configured to position the electric interface at the second position while the print fluid cartridge is being mounted in a cartridge receiving portion, the positioning being performed by abutment contact of the supporting member with the cartridge receiving portion.

8. The print fluid cartridge according to claim 1, wherein the electric interface is provided at an external surface of the main body that is other than the first surface and the second surface, the electric interface being located on an upstream side of the second surface of the main body in the first direction when the electric interface is at the first position, the electric interface being located on a downstream side of the second surface of the main body in the first direction and supported by the main body when the electric interface is at the second position.

9. The print fluid cartridge according to claim 8, wherein the main body is provided with a supporting member that is configured to move relative to the main body in the first direction and in the direction opposite to the first direction and to support the electric interface.

10. The print fluid cartridge according to claim 9, wherein the main body includes a guide configured to guide the supporting member to move.

11. The print fluid cartridge according to claim 9, wherein the supporting member includes a locking mechanism configured to position the electric interface at the second position while the print fluid cartridge is being mounted in a cartridge receiving portion, the positioning being performed by engagement of the locking mechanism with the cartridge receiving portion.

12. The print fluid cartridge according to claim 11, wherein the locking mechanism includes an operating part configured to release engagement of the locking mechanism from the cartridge receiving portion.

* * * * *